United States Patent [19]

Wagner

[11] Patent Number: 4,730,822

[45] Date of Patent: Mar. 15, 1988

[54] APPARATUS FOR MARKING INDIVIDUAL RUNS OR PORTIONS OF A STACK OF PRINTED SHEETS

[75] Inventor: Josef Wagner, Wiesbaden-Delkenheim, Fed. Rep. of Germany

[73] Assignee: Neue Rotaprint GmbH, Berlin, Fed. Rep. of Germany

[21] Appl. No.: 786,007

[22] Filed: Oct. 10, 1985

[30] Foreign Application Priority Data

Oct. 11, 1984 [DE] Fed. Rep. of Germany ..... 3437348

[51] Int. Cl.[4] ..... B65H 45/22

[52] U.S. Cl. ..... 270/95; 414/119

[58] Field of Search ..... 270/95; 271/221, 223; 414/119, 118, 131, 35, 37, 40, 85

[56] References Cited

U.S. PATENT DOCUMENTS

| | | | |
|---|---|---|---|
| 1,258,027 | 3/1918 | Lindbladh | 270/95 X |
| 1,611,762 | 12/1926 | Maxson | 270/95 |
| 1,834,568 | 12/1931 | Winkler et al. | 270/95 |
| 2,855,833 | 10/1958 | Rugg et al. | 270/95 |
| 2,918,852 | 12/1959 | Buccicone . | |
| 3,933,352 | 1/1976 | Sinn | 271/221 |
| 4,136,864 | 1/1979 | Obenshain | 271/221 X |
| 4,396,336 | 8/1983 | Malamood | 270/95 |
| 4,397,598 | 8/1983 | Ess et al. | 271/221 X |
| 4,477,218 | 10/1984 | Bean | 271/221 |

FOREIGN PATENT DOCUMENTS

| | | | |
|---|---|---|---|
| 1550146 | 8/1979 | European Pat. Off. . | |
| 0038169 | 10/1981 | European Pat. Off. . | |
| 2525422 | 9/1976 | Fed. Rep. of Germany . | |
| 2551497 | 5/1977 | Fed. Rep. of Germany | 271/223 |
| 7509912 | 10/1976 | Netherlands | 271/221 |
| 2093807 | 9/1982 | United Kingdom . | |

*Primary Examiner*—E. H. Eickholt

*Attorney, Agent, or Firm*—Cushman, Darby & Cushman

[57] ABSTRACT

A device for use with a sheet stacker for developing a marking or identifying sheet to separate groups within the stack as the latter is being formed. The device is comprised of a paper stop member that is movable between two positions, one for defining the boundary of the primary stack and a second position, spaced outwardly of the stack boundary, at a point defining the position for the marking sheet.

19 Claims, 4 Drawing Figures

APPARATUS FOR MARKING INDIVIDUAL RUNS OR PORTIONS OF A STACK OF PRINTED SHEETS

FIELD OF THE INVENTION

The present invention relates to apparatus for marking or identifying individual runs or portions of stacks of printed sheets on a sheet receiving deck of a machine from which a plurality of sheets are sequentially fed, such as, for example, a printing machine.

BACKGROUND OF THE PRESENT INVENTION

When successively printing from different originals, the sequentially formed stacks of sheets bearing the different printed results may be superimposed directly on the sheet receiving deck of the printing machine without the plane of separation between the individual stack portions being readily discernible. A variety of proposals have been made to distinguish these individual stack portions or runs. For example, a known pivotable-deck design has the sheet receiving deck pivoted slightly about its vertical axis at the end of each run so that the following sheets printed from the next original, or the partial stack formed thereof, will be deposited at a slight relative to the previously printed sheets. By pivoting the sheet receiving deck alternatively back and forth, the individual stack portions may be distinguished readily. However, this design usually does not include a deck which may be lowered. Also, the design is disadvantageous in that it requires additional structure for the sole purpose of marking the different runs. Thus, it is necessary to provide both for the pivoting mounting of the sheet receiving deck and for a mechanism to impart pivoting movement to the deck.

Also, it has been known to mark individual stack portions by inserting paper slips between them. This solution is disadvantageous in that the stack in its entirety may be deposited out of angle, and additional structure, i.e. slip insertion apparatus, must be provided at a suitable position in the machine, which may lead to space problems. Also, that solution may create particular difficulties in case the sheet receiving deck is not lowered gradually, so that the top of the stack will be at different levels at different times.

One of the objects of the present invention is to improve on the apparatus mentioned above so that individual runs or stack portions of sheets of paper deposited on the sheet receiving deck of a machine may be marked clearly without using either a pivoting deck or any separate slip inserting mechanism. This object is to be attained by technical and a design as simple and inexpensive as possible, i.e. utilizing as far as possible constructional elements already available on the printing machine.

SUMMARY OF THE PRESENT INVENTION

In accordance with the invention, marking of runs or batches is accomplished by using a stop for the paper sheets that is displaceable relative to the side of the stack being developed. This can be achieved by employing two stops placed one behind the other in the direction of sheet discharge and deposition on the deck, instead of a single stop, and by briefly deactivating or moving the stop which is first in the direction of discharge to expose the second stop spaced from the first in the direction of sheet travel. The individual runs or stack portions may now be clearly marked, with the structure added to the machine being very simple and inexpensive.

For example, in the case of an electronically controlled printing machine, which initially has only one stop at the gradually lowerable sheet receiving deck, it is necessary only to provide at the deck another stop device which is rearwardly offset from the first stop in the direction of sheet discharge and a way to move the first out of the sheet travel path so that sheets can intersect the second stop. Thus, the electronic printing machine must be programmed to issue suitable commands for a relative change of the position between the one (first) stop and the sheet receiving deck of the top of the stack, respectively, to expose the second or rearward stop. This may be accomplished by causing the drive mechanism moving the gradually lowerable deck, which drive is present in the machine anyway, to briefly lower the latter in a manner such that the top of the stack is on a level slightly below the bottom end of the first or front stop. Alternatively the first stop could be moved relative to the top or side surface of the stack while the sheet receiving deck or the top of the stack would not change position so that sheets will be stopped at a position outwardly of the normal stack boundary. The latter measure may be realized in a most simple manner by means of a solenoid.

The aforesaid solution has particular utility in offset printing machines in which the printing foils or originals are changed automatically and different hatches or runs are printed in rapid succession. The electronic control means included in the printing machine can provide for a temporary change of the position of one of the stops, relative to the direction of sheet discharge or relative to the top of the stack, with such change being properly phased with the change of a printing foil. By changing the position of the stop member, a sheet, which may in fact be an empty sheet, is free to move past a first stop position toward a second stop position, whereby a "separating sheet" that extends outwardly beyond the boundary defined by previously fed sheets, will be created between two adjacent batches or runs. Besides, the inventive solution is of interest also where the printing foils or originals are not changed automatically, if it is desired, for example, to insert a separating sheet after a predetermined number of similar printed sheets has been discharged onto the deck; that separating sheet may in fact be one of the printed sheets of that run.

Other objects, features, and characteristics of the present invention, as well as the methods and operation and functions of the related elements of the structure, and to the combination of parts and economies of manufacture, will become more apparent upon consideration of the following description and the appended claims with reference to the accompanying drawings, all of which form a part of this specification, wherein like reference numerals designate corresponding parts in the various figures. The attached drawings illustrate the principles of the present invention by showing two embodiment examples thereof, with the actual printing machine having been omitted as the essential features herein relate to the sheet receiving deck and the two stops and the positions or the adjustment thereof relative to each other.

DETAILED DESCRIPTION OF THE PREFERRED EXEMPLARY EMBODIMENTS

Figure 1:
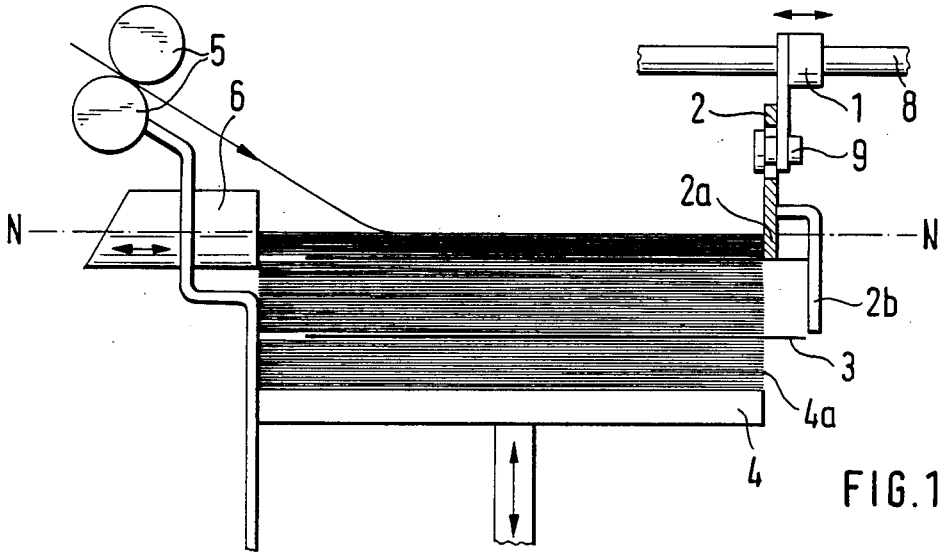
FIG. 1 shows the stack of printed sheets deposited on the sheet receiving deck while a run is being printed (top of the stack at level N-N)

Turning now to FIG. 1, there is shown a sheet receiving deck 4 onto which a stack of sheets 4*a* have been discharged. The position of the stack 4*a* is that normally assumed in the printing process. During the printing process, and as sheets continue to be received, the receiving deck 4 is gradually lowered in the usual manner so as to maintain the top of the stack approximately at level N-N. Discharge rollers 5 are suitably supported at the outlet of the printing machine (not shown) and printed sheets are added to the stack following their being propelled from between discharge rollers 5 in the direction of arrow 7. The propelled sheets slide across the top surface of the stack until they strike a stop member, generally indicated at 2, which has a front or first stop portion 2*a* and a rear or second stop portion 2*b* spaced rearwardly of front portion 2*a* thereby defining two stop positions. The first position will define the normal stack boundary while the second will define the position of the marking sheet outboard of the stack boundary.

Stop 2 is mounted on a bar 8 via a holder 1, discussed further below. In this exemplary embodiment, front stop portion 2*a* has a length smaller than the length of rear stop portion 2*b*, so that front portion 2*a* extends downwardly a smaller distance than rear portion 2*b*. In the normal operating position for stop 2 while a run of sheets is being printed, as shown in FIG. 1, the top of the stack of sheets is kept aligned with the length of front stop portion 2*a* whereby the discharged sheets slide towards and come to rest against front stop portion 2*a*. On the opposite side of the stack (left side in FIG. 1), a conventional reciprocating stack pusher member 6 is provided to ensure formation of a proper stack by moving back towards stop 2, 2*a* any sheets which have rebounded therefrom. It is not believed that any further description of this conventional stack pusher is required to present a fully clear and concise description of the present invention.

Conventional sensing means are provided in a usual manner to maintain the top surface of the stack at level N-N. If the top surface of the stack is higher than that level, as may be caused by the continuously arriving printed sheets, a suitable command is issued, based on the sensed stack height, to lower the sheet receiving deck 4 and the top of the stack to the aforesaid lower level. Such sensing means may comprise a conventional capacitive sensing element incorporated in the stack pusher member 6 and is included electrically in the height control circuit for deck 4. Thus, in normal printing operations, a deck height control circuit and the associated drive mechanism will cause the sheet receiving deck 4 to be continuously monitored and lowered as the top of the stack rises due to the continued discharge of printed sheets thereon, to maintain the top of the stack at a substantially constant level.

Use of a stop having afront stop position and a rear stop position and the position change therebetween, one relative to the other and/or the displacement thereof relative to the stack constitute the core of the present invention.

Figure 2:
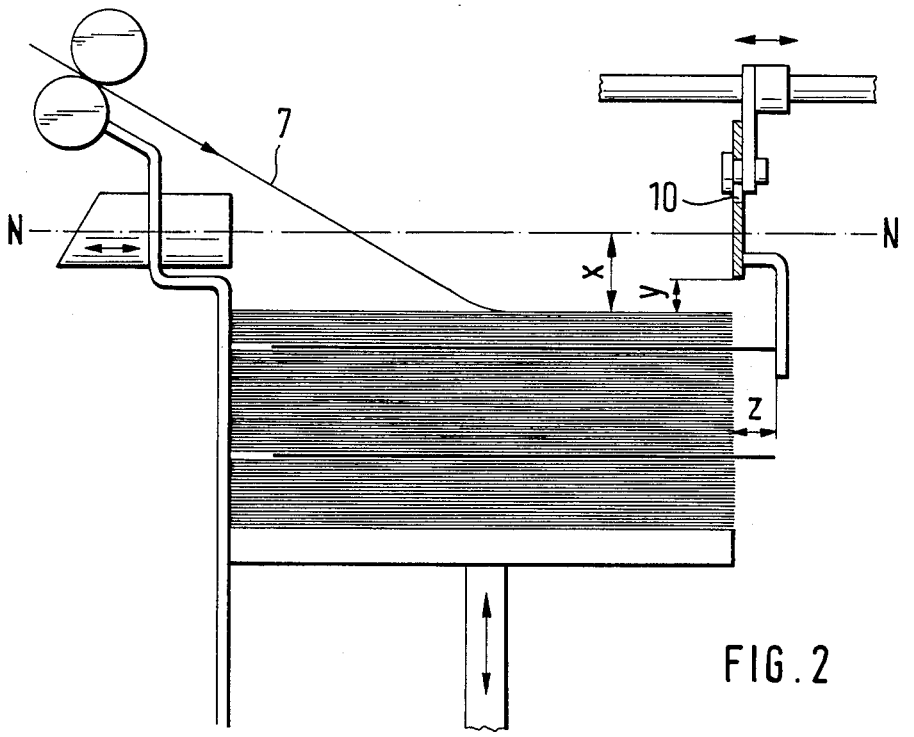
FIG. 2 shows the stack of sheets after a run has been finished (top of the stack lowered by an amount X below level N-N)

A holder mechanism 1 has stop 2 mounted thereon with stop portions 2*a* and 2*b* being mutually offset by a distance Z, as shown in FIG. 2, in the direction of sheet discharge. Holder 1 is mounted for horizontal sliding movement, such as on a horizontal bar 8 which extends from and is mounted by any convenient means to the printing machine frame. Accordingly, holder 1 and stop 2 may be adjusted to accomodate different sheet lengths. Holder 1 has a depending portion 11, the bottom of which supports a pin 9 which extends into and through a vertically extending slot 10 provided in stop 2. Accordingly, stop 2 is adjustable vertically. As shown in FIG. 1, front portion 2*a* of stop 2 rests on a previously introduced separating sheet and thus acts to stop the longitudinal movement of the subsequent sheets sliding across the stack. Through its front portion 2*a*, stop 2 rests with its full weight on the separating sheet protruding from stack 4*a*. It is possible, however, to increase that load by means such as springs.

As shown in the drawings, stop 2 with its front and rear portions 2*a*, 2*b* has in the place of the drawing the shape of a fork having two tines, with the front tine, front stop portion 2*a* being somewhat shorter than the rear tine, rear portion 2*b*.

Figure 3:
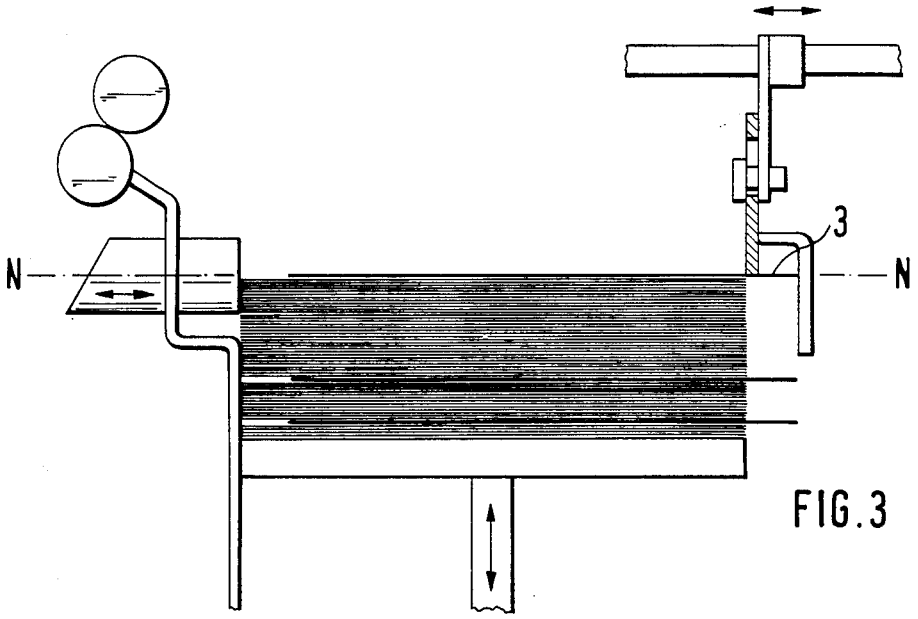
FIG. 3 shows the stack of sheets prior to the discharge of a new run (top of stack again raised to level N-N)

Once a desired number of sheets has been printed, in the embodiments shown in FIGS. 1 to 3, a machine control circuit generated command causes sheet receiving deck 4 to be lowered a distance X below level N-N so as to create a gap of height Y between the topmost sheet on stack 4*a* and the lower (horizontal) end of front stop portion 2*a*. A printed or unprinted sheet 3 propelled across the top of the stack at this time will be stopped by rear stop portion 2*b*, which is spaced rearwardly from front portion 2*a* by a distance Z in the direction of discharge. By allowing this sheet 3 to extend out beyond the edge or boundary of the stack 4*a*, the various printing runs or batches will be separated on the sheet receiving deck in a clearly visible manner by such separating sheets 3, the only ones extending outwardly beyond the stack. As soon as the separating sheet 3 has been deposited on the stack and either the feeding thereof or its arrival is sensed, deck 4 receives a suitable command to move up, i.e. deck 4 and stack 4*a* thereon are raised until the top of the stack with the one separating sheet thereon has again reached level N-N, as shown in FIG. 3. In the process, front stop portion 2*a* will again engage and rest on the over hanging portion of that now topmost separating sheet 3 so that the next following sheets to be deposited on stack 4*a* will again be stopped by front stop portion 2*a* and thus be aligned with the original side boundary of stack 4*a*.

Figure 4:
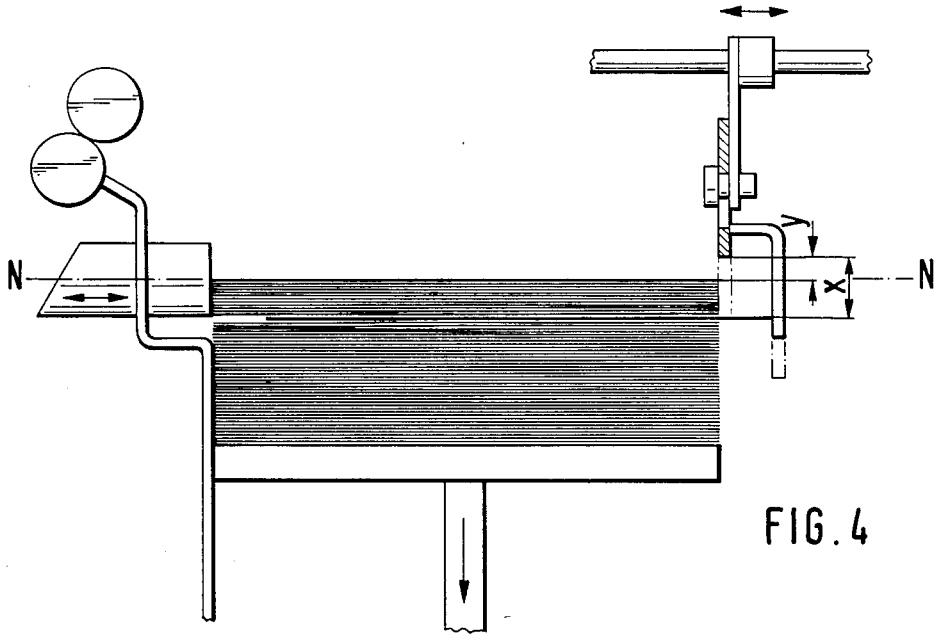
FIG. 4 shows the kinematic reversal of the embodiment shown in FIGS. 1 to 3, with the top of the stack constantly at level N-N and the second stop being moved vertically (by a solenoid or the like) to create a gap Y allowing for further longitudinal movement of the separating sheets in case of such is needed.

The same effect may be obtained by a kinematic reversal embodied in the arrangement shown in FIG. 4. In contrast to FIG. 2, when introducing a separating sheet 3, sheet receiving deck 4 is not lowered by a distance X and the top surface of stack 4*a* is constantly maintained at level N-N. Stop 2 is itself moved relative to the stack, for example, by being raised upwardly by means of holder 1 or rod 8 by a distance X (FIG. 4) so as to create a gap having a width Y between the top surface of the stack and the lower horizontal end of front stop portion 2*a*. With stop 2 in that position, the next printed or unprinted sheet discharged from rollers 5 will again slide across the top of the stack and will only be stopped once it projects beyond the boundary of the stack of sheets by a length Z. Thereafter, stop 2 is again moved back to its initial position relative to the stack, in this instance, it is lowered, so that the lower end of front stop portion 2*a* rests on that topmost separating sheet 3, again as in FIG. 3. The temporary upward movement of holder 1, or of the stop 2 coupled thereto via an elongated slot, may be effected by means of a solenoid or the like and it is not believed to be necessary for a full, clear and complete understanding thereof to be described or shown in further detail. However, it should be understood that the activation of the raising mechanism, e.g., the energization of a solenoid, could be effected in response to a sensed condition corresponding to the number of sheets fed, stack position, or some other variable parameter associated with the machine or the process, or even manually.

Another embodiment of the present invention, which is not shown in detail herein, is to provide a holder 1 which is mounted for longitudinal movement along rod 8 and designed itself to act as stop portion 2*b*, with stop portion 2*a* being mounted on holder 1 for independent movement (by means of a solenoid, for example).

Another modification would be to mount the front stop member for pivoting movement about an axis extending in parallel with the front edge of the stack of sheets so that the front stop member in its first stop position may be deactivated temporarily. This way, it would be possible without any other constructional means to develop a second stop position spaced from the first to have a sheet stop at a different point, relative to the stack, to thereby mark the individual batches or runs by separating sheets extending forwardly from the stack.

The essential point is to create two spaced apart stop locations, as by a brief displacement of the stop member relative to its normal first stop position, vis a vis the side of the stack, to allow a sheet to stop at a different second position where it would extend outwardly beyond the stack boundary when stopped at that second position. Alternatively, a front stop member could be moved relative to the top of the stack, with a second or rear stop member being stationary, though adjustable for printing sheets having different lengths.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

I claim:

1. Apparatus for identifying runs or portions of stacks of sheets on a sheet receiving deck of a printing machine mounted to a means for gradually lowering said deck to compensate for increasing stack height, comprising:

stop means for stopping the movement of sheets received on said deck;

means for moving said stop means relative to said deck between first and second positions so as to define first and second stop positions, said first stop position defining a normal side boundary of said stack and said second stop position being spaced outwardly a predetermined distance from said normal side boundary so that sheets stopped at said second stop position will project outwardly beyond said normal side boundary, said means for moving said stop means including means for moving said stop means relative to a stack on said deck to define said second stop position after a predetermined number of sheets have been disposed on the stack so that a path is defined for a next discharged sheet to move toward and be stopped at said second stop position and means for moving said stop means relative to the stack to define said first stop position after said next discharged sheet has been disposed on the stack.

2. Apparatus as in claim 1, further including means for mounting said stop means so that said stop means is vertically movable between first and second positions relative to said deck.

3. Apparatus as in claim 1, including means for mounting said stop means so that said stop means is horizontally movable between first and second positions relative to said deck.

4. Apparatus as in claim 1, including means for mounting said stop means so that said stop means is pivotally movable between first and second positions relative to said deck.

5. Apparatus as in claim 1, further including means for mounting said stop means to said printing machine so that said stop means is movable between a position immediately adjacent said deck and a second position spaced from said deck.

6. Apparatus as in claim 1, further including solenoid means operatively coupled between said stop means and the printing machine for moving said stop means relative to said deck.

7. Apparatus as in claim 1, wherein said stop means is mounted to said means for moving by means of a pin and slot so as to be vertically movable relative to said means for moving and so as to rest on said next discharged sheet under the influence of the weight of the stop means.

8. Apparatus as in claim 1, further including push means for pushing the stack of sheets on the deck against said stop means so as to maintain stack formation.

9. Apparatus for marking individual runs or portions of stacks of printed sheets on a sheet receiving deck of a printing machine mounted to a means for gradually lowering said deck to compensate for increasing stack height, comprising:

a first stop mounted adjacent to said deck at a level corresponding to the top stack surface for limiting the forward movement of printed sheets propelled from the printing machine by a means for propelling sheets in a direction of discharge from the machine and a second stop spaced from said first stop in the direction of sheet discharge; and means for moving said deck relative to said first stop after a predetermined number of sheets have been disposed on the stack so that a path is defined for a next discharged sheet to move toward and engage said second stop and means for moving said deck relative to said first stop after said next discharged sheet has been disposed on the stack.

10. Apparatus as in claim 9, wherein said first stop is mounted so as to be stationary relative to the printing machine and the sheet receiving deck is movable downward relative to said first stop.

11. Apparatus as in claim 9, further including means for mounting first stop so that said first stop is vertically movable between first and second positions relative to said deck.

12. Apparatus as in claim 9, including means for mounting said first stop so that said first stop is pivotally movable between first and second positions relative to said deck.

13. Apparatus as in claim 9, further including means for mounting said first stop to said printing machine so that said first stop is movable between a position immediately adjacent said deck and a second position spaced from said deck.

14. Apparatus as in claim 9, further including solenoid means operatively coupled between said first stop and the printing machine for moving said first stop relative to said deck.

15. Apparatus as in claim 9 further including push means for pushing the stack of sheets on the deck against said first stop so as to maintain stack formation.

16. Apparatus for marking individual runs or portions of stacks of printed sheets on a sheet receiving deck of a printing machine mounted to a means for gradually lowering said deck to compensate for increasing deck height, comprising:

a first stop mounted adjacent said deck at a level corresponding to the top stack surface for limiting the forward movement of printed sheets propelled from the printing machine by a means for propelling sheets in a direction of discharge from the machine and a second stop spaced from said first stop in the direction of sheet discharge; and means for moving one of said first stop and said deck relative to the other after a predetermined number of sheets have been disposed on the stack so that a path is defined for a next discharged sheet to move toward and engage said second stop and means for moving one of said first stop and said deck relative to the other after said next discharged sheet has been disposed on the stack, said first stop being mounted to said means for moving by means of a pin and slot so as to be vertically movable relative to said deck and so as to rest on said next discharged sheet under the influence of the weight of the first stop.

17. Apparatus as in claim 16, further including push means for pushing the stack of sheets on the deck against said first stop so as to maintain stack formation.

18. Apparatus for marking individual runs or portions of stacks of printed sheets on a sheet receiving deck of a printing machine mounted to a means for gradually lowering said deck to compensate for increasing stack height, comprising:

stop means defining a first stop adjacent said deck at a level corresponding to the top stack surface for limiting the forward movement of printed sheets propelled from the printing machine by a means for propelling sheets in a direction of discharge from the machine and defining a second stop spaced from said first stop in the direction of sheet discharge;

means for mounting said stop means so that said stop means is horizontally movable between first and second positions relative to said deck so as to define said first stop and said second stop; and means for moving said stop means relative to said deck after a predetermined number of sheets have been disposed on the stack so that a path is defined for a next discharged sheet to move toward and engage said second stop and means for moving said stop means relative to said deck after said next discharged sheet has been disposed on the stack.

19. Apparatus as in claim 8, further including push means for pushing the stack of sheets on the deck against said stop means so as to maintain stack formation.

* * * * *